US005329672A

United States Patent [19]

Froehlich et al.

[11] Patent Number: 5,329,672

[45] Date of Patent: Jul. 19, 1994

[54] METAL WIRE PAPER CLIP STRUCTURE

[76] Inventors: Linda A. Froehlich; Richard D. Froehlich, both of 5151 Keiners La., Pittsburgh, Pa. 15205

[21] Appl. No.: 604,970

[22] Filed: Oct. 29, 1990

Related U.S. Application Data

[63] Continuation of Ser. No. 45,452, May 4, 1987, abandoned, which is a continuation of Ser. No. 764,566, Aug. 12, 1985, abandoned.

[51] Int. Cl.[5] ..... B42F 1/04

[52] U.S. Cl. ..... 24/67.9

[58] Field of Search ..... 24/67.9, 546, 545, 547

[56] References Cited

U.S. PATENT DOCUMENTS

| | | | |
|---|---|---|---|
| 742,892 | 11/1903 | McGill | 24/547 |
| 742,893 | 11/1903 | McGill | 24/547 X |
| 2,269,649 | 1/1942 | Comley | 24/547 |
| 4,017,337 | 4/1977 | Winter et al. | 24/547 X |
| 4,597,139 | 7/1986 | Lau | 24/546 |

FOREIGN PATENT DOCUMENTS

| | | | |
|---|---|---|---|
| 665847 | 9/1938 | Fed. Rep. of Germany | 24/546 |

*Primary Examiner*—James R. Brittain

*Attorney, Agent, or Firm*—Raymond N. Baker

[57] ABSTRACT

Improved paper clip is formed from a single piece of spring-quality metal wire to have an elongated U-shaped inner loop nested within an elongated U-shaped outer loop. Each loop includes a free leg and a connector leg; the longitudinally-extending leg portions of the free leg and connector leg of each respective loop are of substantially the same length. The U-shaped loops are joined together by an arcuately-curved interconnector extending between the connector leg of each loop. Distal ends of the free leg of each loop are located contiguous to such arcuately-curved interconnector which defines one longitudinal end of the paper clip; with such new configurational and other features, damage to outer surfaces of stacked paper by such distal ends is avoided and clasping force is applied along substantially the full length of such free legs during use of the improved clip.

5 Claims, 2 Drawing Sheets

METAL WIRE PAPER CLIP STRUCTURE

This is a continuation of application Ser. No. 07/045,452 of May 4, 1987, now abandoned, which was a continuation of application Ser. No. 06/764,566 filed Aug. 12, 1985, now abandoned, the entire disclosures of which are incorporated herein by reference.

This invention is concerned with improved metal wire paper clip structure with unique configurational aspects providing improved performance especially with relatively thick stacks of paper.

The metal wire paper clips of interest herein are formed from a unitary length of wire to form two interconnected U-shaped loops.

In the prior art, the leg portion of the U-shaped loops differed significantly in length. Also, one leg of each loop (the connecting leg) had to be extended longitudinally to permit joinder by a curved interconnecting portion at the one longitudinal end of the clip; and, the free distal end of the remaining leg of each U-shaped loop was located along the main body of the clip—significantly spaced longitudinally from the curved interconnecting portion. Prior to use, the longitudinally-extending portions of the legs of one loop were in contact with adjacent leg portions of the other loop.

When a clip of such prior art structure is applied to a stack of papers having a thickness about ¼ to ½ the radius of such curved interconnecting portion, very little gripping force is exerted on the paper along the length of the connecting legs. In fact, the connecting legs engage such a stack of papers only in the region adjacent the edge of the stack. Only the remaining (free) legs exert clasping force internally of the edge of the stack and their distal ends, especially the distal end of the inner loop free leg, leg, tend to dig into the outer surface of the stack. It is then necessary to further deform the clip in order to remove it from the stack of papers without tearing the surface sheets; permanent deformation of the clip or puncture-tearing of the papers frequently being the only alternatives; likelihood of tearing is more pronounced with stacks of computer print-out paper which have perforations along side edges.

It has been found that increasing the size of the conventional configuration clip and/or use of heavier metal wire for purposes of clipping together such relatively thick stacks of paper does not relieve these problems.

Such difficulties and disadvantages of the prior art paper clip are substantially alleviated by configurational and other changes taught herein.

In accordance with the invention, both the inner and outer loop free legs of a unitary metal wire clip are significantly longer proportionally than those of a conventional clip; for example, the free leg and the connecting leg of each individual U-shaped loop are substantially equal in length. Also, such free legs terminate contiguous to one longitudinal end of the clip rather than along its main body. This provides the advantage of distributing the gripping force of the improved clip along a greater length of each leg and moves the clasping force of the free legs from their distal ends to the main body portion of each. As a result, there is substantially less tendency and opportunity for the distal ends of the free legs to dig into the paper. The contributions of the invention are pronounced and more observable with relatively large clips, having an overall length on the order of four inches, when used on relatively thick stacks of paper and, in particular, on stacks of computer print-out paper which previously required the more expensive three-piece binder clip.

In addition, it has been found that superior gripping without permanent deformation of a unitary metal wire clip can be attained by making the inner U-shaped loop somewhat narrower in width than the interior of the outer U-shaped loop, so that the inner loop legs are spaced laterally (normal to the longitudinal axis of the clip) from adjacent outer-loop legs.

By virtue of a combination of features, a clip is provided which does not require an excessive amount of wire, is resistant to permanent deformation when used with a thick stack of papers, and has legs with free ends which do not dig into a clipped stack of papers. Also, forces exerted on a stack of paper by the clip, as compared with a conventional clip, are more evenly distributed over larger areas of the surfaces of a stack of paper.

Other advantages and contributions of the invention, and comparisons with the prior art, are considered in more detail with reference to the accompanying drawings, in which.

Figure 1:
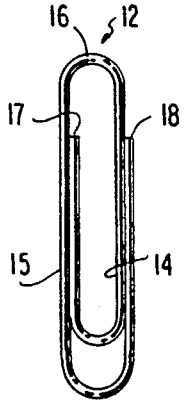
FIG. 1 (PRIOR ART)
FIG. 1 is a plan view showing the conventional configuration of prior art paper clips.

The more popular sizes for prior art paper clip 12 of FIG. 1 are on the order of 1¼ inches to two inches in overall length. Inner-loop connecting leg 14 and outer loop connecting leg 15 are extended in length in relation to the free leg of their respective loops to permit joinder by curved interconnector 16. Distal ends 17, 18 of respective inner and outer loop-free legs are located along the main body of clip 12, typically about one-fourth the distance longitudinally from the curved interconnector 16 end of the clip; e.g. with a clip having a two-inch overall length, such distal ends are located about one-half inch from the midpoint of curved interconnector 16.

Figure 2:
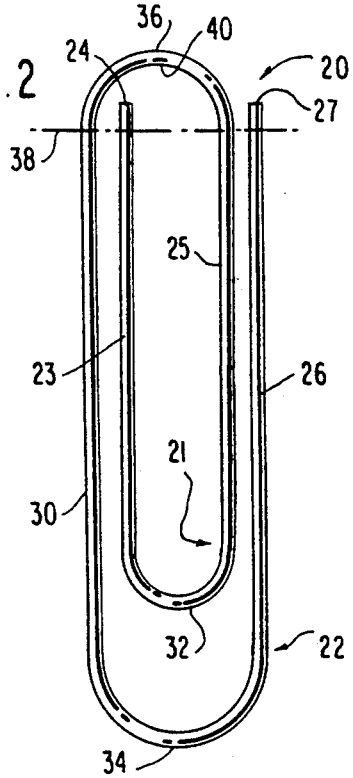
FIG. 2 is a plan view of a preferred embodiment of a paper clip in accordance with the invention.

Paper clip 20 of FIG. 2 shows new configurational features of an embodiment of the invention which is preferably substantially larger than the more popular sizes of clip 12 of FIG. 1. Typically, the overall length of the paper clip 20 is on the order of four inches, but the advantages of the present invention are similarly pronounced and observable in embodiments where the clip 20 is between about three and about five inches in length. The clip can also be made in smaller sizes while retaining significant advantages of the new configuration.

Referring to FIG. 2, the paper clip 20 is formed from a unitary length of metal wire of substantially uniform diameter, bent to form an elongated inner U-shaped loop 21 within an elongated outer U-shaped loop 22. Spring quality round wire, as described in more detail later herein is used; typically, twelve (12) to fourteen

(14) gage wire is used in making a four-inch clip from steel.

Inner loop 21 presents a free leg 23, i.e. a leg with a free end 24, and a connecting leg 25; free leg 23 and connecting leg 25 extend about the same distance along the longitudinal direction of the elongated clip. Outer loop 22 presents free leg 26, with free end 29, and connecting leg 30; free leg 26 and connecting leg 30 extend about the same distance in such longitudinal direction. The open ends of the U-shaped loops face toward the same longitudinal end; the curvilinear closed ends 32, 34 of the respective inner and outer loops are disposed toward the remaining longitudinal end of the clip 20.

Inner-loop connecting leg 25 and outer-loop connecting leg 30 are joined together, without the requirement for extending their lengths with relation to respective free legs, by a smoothly-curved arcuate-configuration interconnector 36. As shown, the straight portion of each connecting leg (25, 30) merges into the curved interconnector 36. The location of such merging of the longitudinally-directed portions of connecting legs with the curved interconnector is indicated in FIG. 2 by phantom line 38. For ease of manufacture, the longitudinally-directed legs 23, 25, 26, and 30 are preferably rectilinear, but are not limited to such a straight-line configuration.

In a preferred embodiment as shown in FIG. 2, such legs are in substantially parallel relationship. Outer-loop connecting leg 30 is laterally spaced from inner-loop free leg 23 by a distance substantially greater than the diameter of the wire from which clip 20 is formed. There is a similar spacing between outer-loop free leg 26 and inner loop connecting leg 25.

In accordance with one aspect of the invention, distal ends 24, 27 of the respective inner and outer loop free legs 23, 26 extend longitudinally at least to a location contiguous to the joinder (at line 38) of the rectilinear portions of connecting legs 25 and 30 with curved interconnector 36; such ends 24, 27 of the free legs terminate in a transverse plane normal to the longitudinal axis of the clip preferably inwardly of a tangent to the inner surface of curved interconnector 36 at its midpoint 40. Curved interconnector 36 defines one longitudinal end of the clip and the curved portion 34 of outer loop 22 defines the remaining longitudinal end. The free ends 24, 27 in the embodiment of FIG. 2 are typically in a common cross-sectional plane normal to the longitudinal direction of clip 20.

The legs and connecting portions of paper clip 20 are coplanar so that the clip is substantially flat when not in use.

Figure 3:
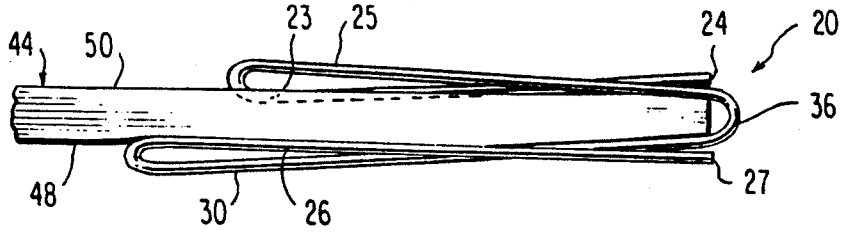
FIG. 3 is a side view of a paper clip according to the invention on a stack of papers.

FIG. 3 shows the paper clip 20 of the invention applied to a stack of papers 44 having a thickness slightly greater than the radius of the curved loop 36. When the clip is in place, inner-loop free leg 23 and outer-loop free leg 26 apply clasping force along approximately their full lengths against surface 48 and surface 50, respectively. With the location of distal ends (24, 27) provided by the configuration taught, the opportunity for the distal ends to dig into the paper is substantially eliminated. Also, an additional clasping force tends to be concentrated toward the inner ends of the free legs compressing the papers as shown in FIG. 3; this adds further holding strength and also has the effect that any spacing of the free legs from the stack surfaces which occurs is developed toward their free ends; this further diminishes the tendency observed with prior art clips for distal ends of the free legs to dig into surface paper. As shown in FIG. 3, a slight spacing is developed between the paper and end portions of the free legs contiguous to the paper stack edge.

Figure 4:
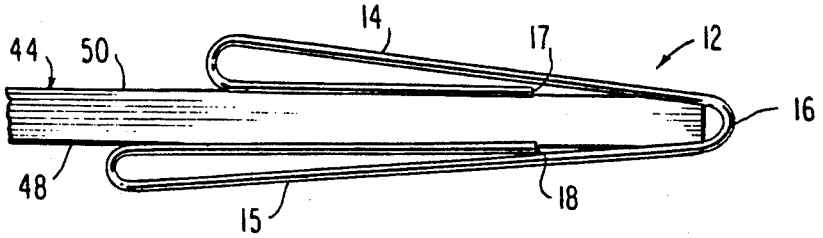
FIG. 4 (PRIOR ART)
FIG. 4 is a side view of a paper clip according to the prior art on the stack of papers as shown in FIG. 3.

In contrast thereto, in an enlarged version of a conventional configuration clip as shown in FIG. 4, with the proportionally shorter free legs and the location of distal ends 17, 18 of the prior art clip 12, there is a component of force at distal ends 17, 18 directed inwardly toward the surfaces 48, 50 which causes these ends to dig into the paper.

Figure 5:
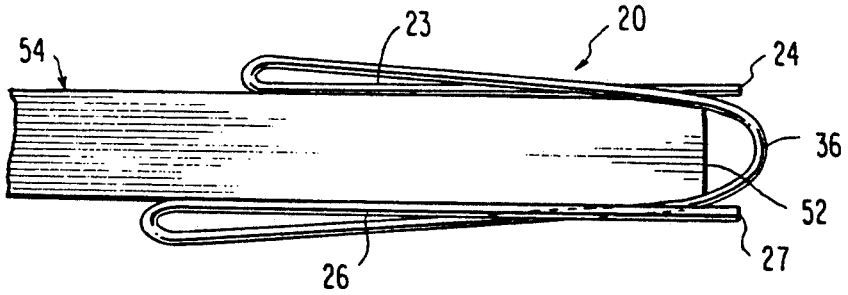
FIG. 5 is a side view of a paper clip of the invention on a thicker stack of papers than shown in FIG. 3.

FIG. 5 shows the paper clip of this invention applied to a thicker stack of papers than that shown in FIGS. 3 or 4. It has been found that the distal ends 24, 27 of free legs 23, 26 tend to project further beyond edge 52 with increasing thickness of stack 54 and it becomes increasingly difficult in ordinary use to force ends 24, 27 internally of edge 52. The thickness of a stack can be further markedly increased over that shown in FIGS. 3 and 4 while maintaining substantially full contact along the lengths of the free legs inwardly of edge 52 with the improved paper clip of the present invention; also, the contact of the connecting legs extends along a major portion of their length, e.g. approximately one-half or more of such lengths.

Figure 6:
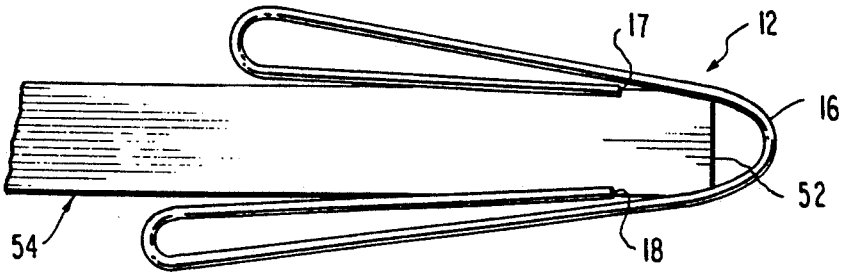
FIG. 6 (PRIOR ART)
FIG. 6 is a side view of a paper clip according to the prior art on the stack of papers as shown in FIG. 5.

However, as shown in the enlarged version of the prior art clip of FIG. 6, this clip functions with ends 17, 18 interior of edge 52. With such location of distal ends 17, 18 and increased stack thickness, there is a stronger component of force tending to urge these ends into the paper; there is also an increased loss of surface contact of the free legs near the closed end of each loop.

The invention teaches use of spring-quality round wire with the added strength providing increased holding force and interaction between the legs on relatively thick stacks of paper diverse types of spring wire are recognized in the wire-making art as having selectable metallurgical characteristics (see, for example, The Making, Shaping and Treating of Steel, 8th Edition 1964 at page 822). The temper of the wire is selected for desired strength properties. The carbon content and the spring amount of cold drawing without anneal are important factors to be considered in selecting steel wire. Medium hard to hard high carbon (above 0.30% C by weight) steels are preferred; e.g. a carbon content of about 0.50 to 0.90% C in twelve (12) to fourteen (14) gage steel wire is used for a paper clip of about four (4) inches in length with a width (lateral dimension of outer loop) of about one (1) inch; cold drawn steel wire designated by the American Society for Testing and Materials (ASTM) A 227 (1977) is representative. Other suitable round wire specifications as designated by the ASTM include steel wire A 228 through A 232 (1977), chromium-nickel stainless steel A 313 (1981), chromium-silicon alloy stock A 401 (1977), brass B 134 (1981) and phosphor-bronze B 159 (1981).

A variety of special finishes for these materials are suitable such as protective coatings of steel, e.g. tinned, galvanized, cadmium plated, zinc plated, chromium plated and bronze or brass plated, or burnished and like finishes.

Figure 7:
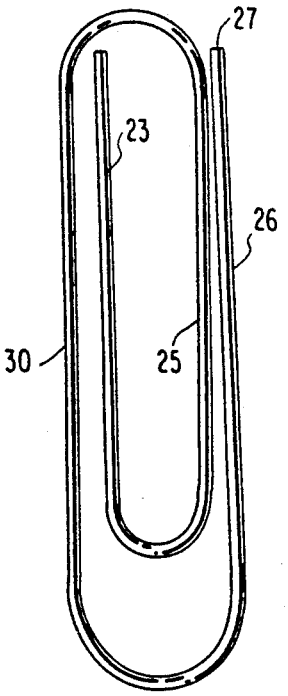
FIGS. 7 through 10 are each plan views of paper clips, with minor configuration variations from the preferred embodiment of FIG. 2, that have satisfactory paper clipping characteristics.

While the longitudinally symmetrical configuration of FIG. 2 is preferred, FIGS. 7 through 10 show configurational variations of portions of paper clip 20 which have been found to be satisfactory (like reference numbers from FIG. 2 are used for like parts in FIGS. 7 through 10). As will be noted from FIG. 7, inner-loop connecting leg 25 need not be spaced uniformly along its entire length from outer-loop free leg 26; e.g. the inner-loop connecting leg 25 can contact the outer-loop free leg 26 near end 27. FIG. 7 also shows that the lateral spacing between inner-loop free leg 23 and outer-loop connecting leg 30 need not be the same as the spacing between inner-loop connecting leg 25 and outer-loop free leg 26.

Figure 8:
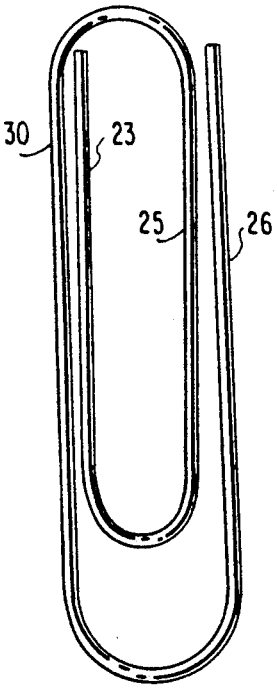

FIG. 8 shows that neither inner-loop leg need be precisely parallel to its adjacent outer-loop leg and that the lateral spacing between adjacent legs need not be identical.

Figure 9:
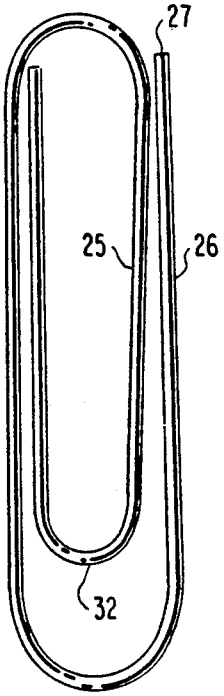

FIG. 9 shows that the lateral dimension of the inner loop need not be precisely uniform throughout its length and that the distal-ends of the free legs need not be located precisely in the same laterally transverse plane.

Figure 10:
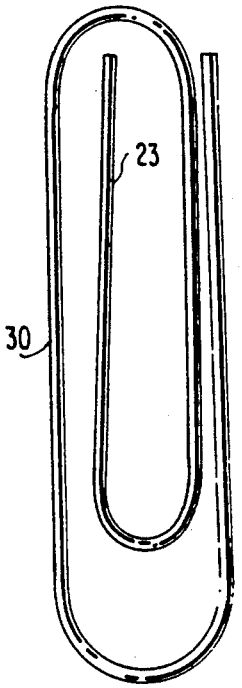

As shown in FIG. 10, inner-loop free leg 23 can be considerably spaced from outer-loop connecting leg 30 and can slope inwardly away from such leg 30 in approaching the open end of its U-shaped configuration.

While a preferred embodiment of the improved paper clip of the invention and minor configurational variations thereof have been shown, representative dimensions set forth, and material characteristics described and set forth, selections other than those specifically presented can be made by those skilled in the art in the light of the above teachings; therefore, reference shall be had to the appended claims for purposes of determining the scope of the present invention.

We claim:

1. A metal wire paper clip comprising a unitary length of spring-quality metal wire bent into an elongated configuration presenting an elongated U-shaped inner loop, an elongated U-shaped outer loop, and an arcuately-curved interconnecting portion therebetween;

each such U-shaped loop having an open end, a closed end, and a pair of longitudinally-extending legs;

such closed end of the elongated U-shaped outer loop defining one longitudinal end of such bent wire elongated configuration, such inner loop being nested within such outer loop with such open end of each such U-shaped loop facing in the same longitudinal direction;

such pair of longitudinally-extending legs of each such U-shaped loop including a free leg having a distal end located at the open end of its respective U-shaped loop, and a connecting leg, such arcuately-curved interconnecting portion extending between such connecting legs at the open end of each such U-shaped loop and defining at its longitudinally outward midpoint the remaining longitudinal end of such bent wire configuration;

each such inner and outer loop free leg extending at least to the juncture of such longitudinally-extending connecting legs with such curved interconnecting portion while not extending beyond a location which is contiguous to a laterally transverse plane normal to the longitudinal axis of the clip which is longitudinally inward of a tangent to the longitudinally inward midpoint of the arcuately-curved interconnecting portion, and each such U-shaped loop and such curved interconnecting portion being substantially coplanar so that the paper clip lies substantially flat when not in use.

2. The structure of claim 1 having a length dimension between longitudinal ends of about three to about five inches and a lateral width dimension between said outer loop longitudinally extending legs of about one inch.

3. The structure of claim 2 in which such spring-quality metal wire comprises high carbon steel having a nominal diameter between about 0.08" and 0.11", with such steel having a protective surface finish.

4. The structure of claim 2 in which such spring-quality metal wire comprises medium hard to hard high-carbon steel cold drawn without anneal of about twelve to about 14 gage, such steel having a protective surface finish.

5. The structure of claim 2 in which such spring-quality metal wire comprises steel having a carbon content in the range above 0.30% C by weight to about 0.9% C by weight, with such steel having a protective surface finish.

* * * * *

US005329672C1

(12) REEXAMINATION CERTIFICATE (4741st)

United States Patent

Froehlich et al.

(10) Number: US 5,329,672 C1

(45) Certificate Issued: Feb. 25, 2003

(54) METAL WIRE PAPER CLIP STRUCTURE

(75) Inventors: Linda A. Froehlich, 5151 Keiners La., Pittsburgh, PA (US) 15205; Richard D. Froehlich, 5151 Keiners La., Pittsburgh, PA (US) 15205

(73) Assignees: Linda A. Froehlich, Pittsburgh, PA (US); Richard D. Froehlich, Pittsburgh, PA (US)

Reexamination Request:
No. 90/003,612, Oct. 31, 1994

Reexamination Certificate for:

| | |
|---|---|
| Patent No.: | **5,329,672** |
| Issued: | **Jul. 19, 1994** |
| Appl. No.: | **07/604,970** |
| Filed: | **Oct. 29, 1990 07/604,970** |

Related U.S. Application Data

(63) Continuation of application No. 07/045,452, filed on May 4, 1987, now abandoned, which is a continuation of application No. 06/764,556, filed on Aug. 12, 1985, now abandoned.

(51) Int. Cl.[7] ..... B42F 1/04

(52) U.S. Cl. ..... 24/67.9

(56) References Cited

U.S. PATENT DOCUMENTS

| | | | | | |
|---|---|---|---|---|---|
| 742,892 | A | * | 11/1903 | McGill | 24/547 |
| 742,893 | A | * | 11/1903 | McGill | 24/547 X |
| 1,985,866 | A | * | 12/1934 | Lankenau | 24/546 |
| 2,269,649 | A | * | 1/1942 | Comley | 24/547 |
| 3,724,036 | A | * | 4/1973 | Botsford | 24/547 |
| 4,017,337 | A | * | 4/1977 | Winter et al. | 148/11.5 A |
| 4,569,172 | A | * | 2/1986 | Weinar | 52/281 |
| 4,597,139 | A | * | 7/1986 | Lau | 24/546 |
| 4,658,479 | A | * | 4/1987 | Sanders | 24/67.9 |

FOREIGN PATENT DOCUMENTS

| | | | | |
|---|---|---|---|---|
| DE | 665847 | * | 9/1938 | 24/546 |

OTHER PUBLICATIONS

Kirk–Othmer, Encyclopedia of Chemical Technology (3rd ed. 1983) vol. 21, pp. 553–601, 605–607.*

The Making, Shaping and Treating of Steel, 8th ed., United States Steel, 1964. p. 822.*

* cited by examiner

*Primary Examiner*—James R. Brittain

(57) ABSTRACT

Improved paper clip is formed from a single piece of spring-quality metal wire to have an elongated U-shaped inner loop nested within an elongated U-shaped outer loop. Each loop includes a free leg and a connector leg; the longitudinally-extending leg portions of the free leg and connector leg of each respective loop are of substantially the same length. The U-shaped loops are joined together by an arcuately-curved interconnector extending between the connector leg of each loop. Distal ends of the free leg of each loop are located contiguous to such arcuately-curved interconnector which defines one longitudinal end of the paper clip; with such new configurational and other features, damage to outer surfaces of stacked paper by such distal ends is avoided and clasping force is applied along substantially the full length of such free legs during use of the improved clip.

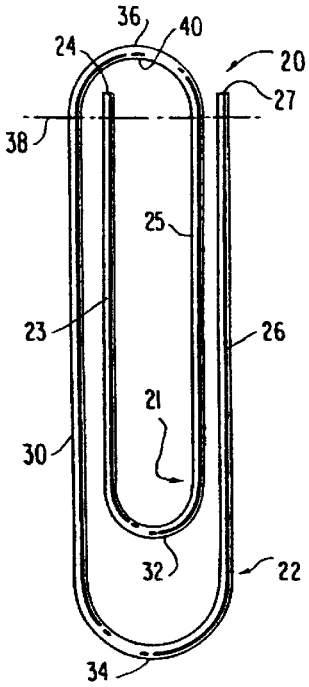

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–5 are cancelled.

* * * * *